United States Patent [19]

Natalie

[11] 4,255,930

[45] Mar. 17, 1981

[54] POWER DEVICE

[76] Inventor: Adam J. Natalie, 16919 Bell St, Riverside, Calif. 92330

[21] Appl. No.: 65,508

[22] Filed: Aug. 10, 1979

[51] Int. Cl.[3] ..... F15B 7/08

[52] U.S. Cl. ..... 60/546; 60/581; 60/583; 92/9; 92/85 B; 92/166; 92/181 P

[58] Field of Search ..... 60/581, 583, 546, 562, 60/567; 92/166, 85 B, 9, 181 P

[56] References Cited

U.S. PATENT DOCUMENTS

| | | | |
|---|---|---|---|
| 2,891,514 | 6/1959 | Moeller | 92/9 |
| 3,158,208 | 11/1964 | Kammerer | 92/9 |
| 3,315,768 | 4/1967 | Stuhler | 92/9 |
| 3,611,517 | 10/1971 | Giersberg | 60/581 |
| 3,990,351 | 11/1976 | Sundin | 92/85 B |
| 4,178,838 | 12/1979 | Stafford | 92/166 |

*Primary Examiner*—Abraham Hershkovitz

*Attorney, Agent, or Firm*—Roger A. Marrs

[57] ABSTRACT

A closed circuit power system is disclosed herein having a hydraulic power device incorporated therein which includes an input piston and cylinder assemblage and an output piston and cylinder assemblage connected together by a fluid conduit so as to operate in unison. The input assemblage includes a piston moved by an input ram so as to apply a fluid pressure via the conduit to the output assemblage. The output assemblage includes a pair of pistons operating in unison in separate chambers in response to the applied fluid pressure for moving an output shaft. The pair of pistons include pressure faces against which the fluid pressure is applied which are of equal area but different shape. A selected piston of the output assemblage includes conical forward and rearward faces with a corresponding or matching concave recess in the rear cylinder wall.

3 Claims, 2 Drawing Figures

FIG. 1
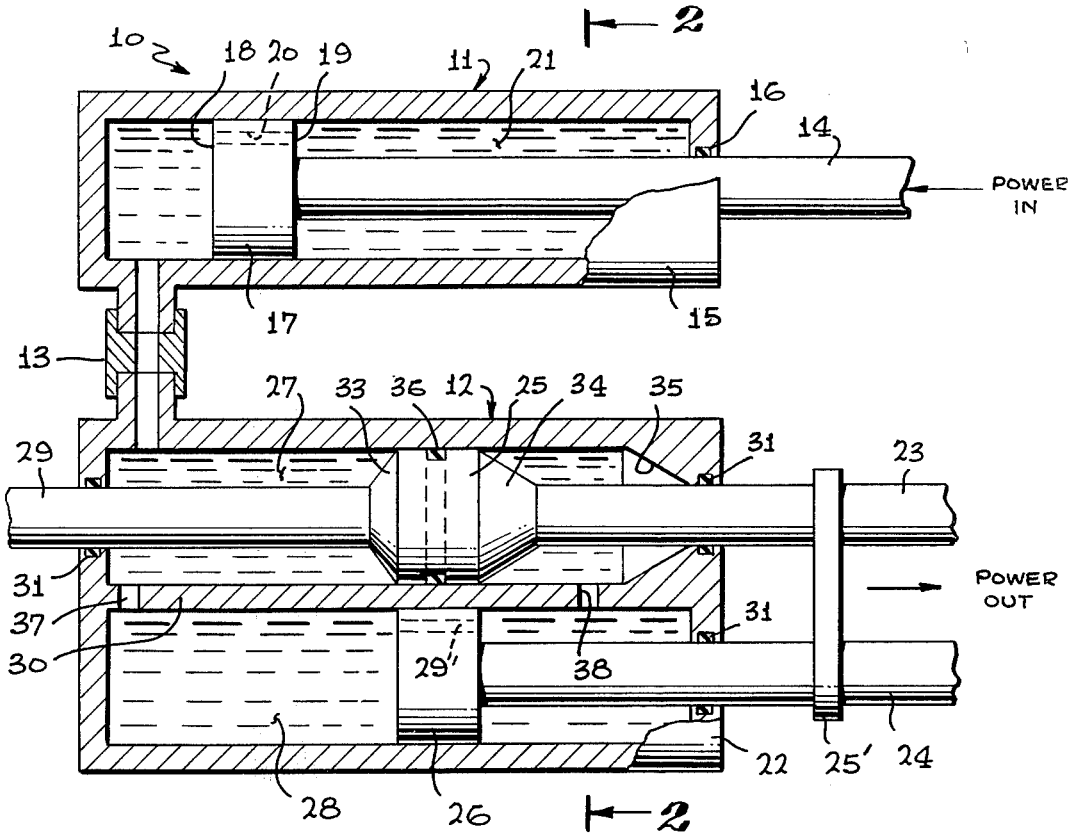
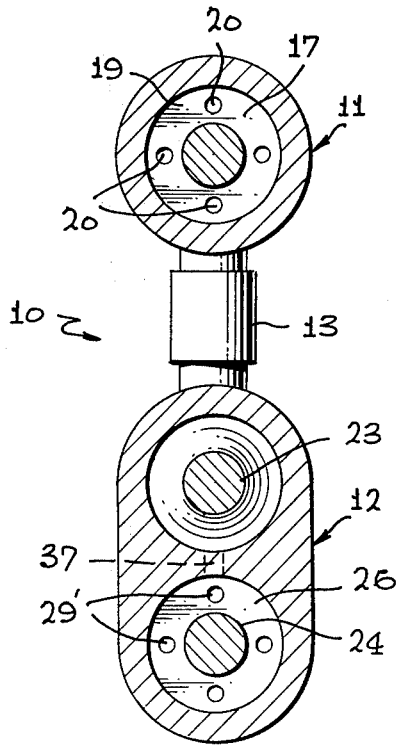
FIG. 2

POWER DEVICE

BACKGROUND OF THE INVENTION

1. Field of the Invention

This invention relates to power devices and more particularly to a novel power device capable of multiplying a power input force by means of a double piston and cylinder assemblage.

2. Brief Description of the Prior Art

In the past, it has been the conventional practice to imploy hydraulic piston and cylinder assemblages to translate an input force into an output force of greater magnitude. Generally, an input load is placed on a ram which urges a piston to move fluid carried in a cylinder. The fluid in turn is directed against an output device such as a plate or other moving member which is attached or connected to an output device so that the force imparted thereto is translated directly to the output device.

Problems and difficulties have been encountered with such prior devices because the ratio of input power to output power is of similar magnitude and the ratio between input to output power is substantially low. Also, the cost of providing such piston and cylinder assemblages is extremely great when compared to the limited results in power multiplication derived therefrom.

Therefore, a long standing need has existed to provide a hydraulic power multiplication unit which employs piston and cylinder assemblages wherein the magnitude is substantially greater than can be obtained through the employment of conventional means.

SUMMARY OF THE INVENTION

Accordingly, the above problems and difficulties are obviated by the present invention which provides a novel power device incorporating an input means and an output means connected together in fluid communication by a fluid conduit. The input means comprises a piston cylinder assemblage having an input ram and a piston operable to apply a hydraulic force via hydraulic fluid out of the cylinder enclosing the piston via the conduit. Ports are provided in the piston for permitting fluid to flow behind the piston in response to movement of the input ram. The output means includes a pair of piston and cylinder assemblages in fluid communication with the first mentioned cylinder whereby the applied hydraulic force is urged against the faces of a pair of pistons carried on output rams in separate hydraulic chambers. Port means are provided between the separate chambers for circulating fluid therethrough between the pair of chambers. A selected piston of the pair is ported so as to pass the hydraulic fluid therethrough as the piston moves within the chamber while the other piston of the pair includes a conical forward face and a conical rearward face which both terminate into the output ram. The rear wall of the chamber facing the conical rear face of the piston is shaped to conform thereto by providing a concave surface mateable with the concave rear face of the piston.

Therefore, it is among the primary objects of the present invention to provide a novel power multiplier which imploys hydraulic piston and cylinder assemblages to achieve a force of greater magnitude than is initially placed into the device.

Another object of the present invention is to provide a novel piston and cylinder power device having an input piston and cylinder assemblage connected by a fluid conduit to an output piston and cylinder assemblage whereby the output force is greater than the wide input force.

Still a further object of the present invention is to provide a novel piston and cylinder assemblage for use in a power multiplying network for deriving an amplified power output incorporating a closed circuit system where the pressures in the hydraulic piston and cylinder assemblages are equal in all chambers.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a diagramatic view, in section, of the novel power device of the present invention illustrating the input piston and cylinder assemblage as well as the output piston and cylinder assemblage interconnected by a fluid conduit; and FIG. 2 is a transverse cross-sectional view of the power device shown in FIG. 1 as taken in the direction of arrow 2—2 thereof.

DESCRIPTION OF PREFERRED EMBODIMENT

Referring to FIG. 1, the novel power device of the present invention is indicated in the general direction of arrow 10 which includes an input means 11 comprising a piston and cylinder assemblage and an output means comprising a twin or double piston and cylinder assemblage 12 which is connected to the input means 11 by a fluid conduit 13. The input means 11 comprises a hydraulic piston and cylinder taking the form of a hydraulic ram 14 which is slideably carried in a cylinder housing 15 via a suitable bearing and seal 16. Within the cylinder 15, the ram 14 is provided with a piston 17 having forward and rear flat faces 18 and 19 respectively. Between the flat faces, the piston is provided with at least four passageways such as passageway 20 which permit hydraulic fluid to flow therethrough. The piston 17 slideably moves within a chamber 21 which is occupied by hydraulic fluid. When the piston is at the extreme righthand side of the cylinder 15, all of the fluid is ahead of the piston 17 and when the piston 17 is at the extreme lefthand side of the chamber within the cylinder 15, all of the fluid is behind the piston. However, it is to be understood as the piston moves between the two extreme positions under force of power input to the ram 14, the fluid will move through the passageways 20.

The hydraulic fluid ahead of the piston 17 in the cylinder 15 is also in communication with the interior of cylinder 22 forming a part of the output means 12. The output means 12 includes a pair of piston and cylinder assemblages taking the form of shafts 23 and 24 which are joined together by a connecting bar 25' so that the shafts will operate in unison when driven in response to the input means. Each of the shafts 23 and 24 carries a piston identified by numerals 25 and 26 respectively which are slideably carried in respective chambers 27 and 28 separated by a barrier 30. It is to noted that the piston 26 includes at least four passageways such as passageway 29' which permits fluid to interflow past the piston when the piston is moved in either direction.

It is also to be noted that the piston 25 includes a shaft 29 which serves to guide the piston as it moves through the cylinder by means of bearing and seals 31. The bearing and seals 30 are in the forward wall of the cylinder 22 and are identical in construction as the bearing and seal 31 associated with shaft 23 in the opposite wall of the cylinder 22. The forward face of the piston 23 is frustro-conical as indicated by the numeral 33 while the rear or aft face is reverse frustro-conical as indicated by numeral 34. The rear wall of the cylinder 22 includes a tapered or concave annular surface 35 which corresponds to and mates with the surface 34 when the shaft or rod 23 is in the extreme forward position. A seal 36 is carried on the piston 25 and seals against the cylinder wall as the piston moves in a rectinear direction.

Not only does the hydraulic fluid flow from the chamber of cylinder 15 via conduit 13 into the chamber 27 but the hydraulic fluid also flows from chamber 27 into the chamber 28 via a port 37 and from chamber 28 into chamber 27 behind piston 25 via a port 38 in the barrier 30. Therefore, it can be seen that all of the chambers of the device are intercommunicated so that the hydraulic oil or fluid is present in every chamber even though the pistons are moving within the chambers.

The twin or double chambered cylinder 22 incorporates the cone-shaped piston 25 as a follower which is slaved to the piston 26 by the bar 25' and the shafts or rods 23 and 24. The piston 25 is so designed that the area of the forward face 33 is equal to one-half the area of the rear face 34. The front face 33 of the piston is designed so that when the pressure is applied equally on both sides, there will not be any movement in either direction. The master or driving piston 26 is equal in area to the piston 25 while the working area of piston 26 would be the diameter of piston rod.

The twin cylinder 22 is coupled to the work cylinder 15 by means of the conduit 13. All chambers in the system are filled with hydraulic oil. As an input force is applied to the ram 14, pressure inside of the motor cylinder chamber 27 and 28 will build. The pressure will be equal in all cylinder chambers. The working area of piston 28 will force piston 17 to move. The motor cylinder will through its piston will move a distance of one inch displacing the hydraulic oil in the motor cylinder chambers of piston 25 and 28, thus causing cylinder 17 to move two inches in direction. The system described is a closed circuit system and at all times, pressures are equal in all chambers. When a force is applied to the motor piston rod 14 or to work cylinder piston rod 24.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hydraulic power device comprising:

an input piston and cylinder assemblage;

an output piston and cylinder assemblage;

a fluid conduit interconnecting said input and said output piston and cylinder assemblages whereby a closed hydraulic circuit is defined therebetween;

said output piston and cylinder assemblage being responsive to movement of said input piston and cylinder assemblage to amplify power produced by said input piston and cylinder assemblage;

said output piston and cylinder assemblage including a housing having a pair of chambers occupied by movable pistons respectively;

means coupling said pistons together so as to move in unison;

hydraulic fluid inter-communicating between said input piston and cylinder assemblage and said chambers via said conduit;

a selected one of said pair of pistons in said chambers is balanced between shafts slidably mounted to said housing by bearings and seals;

said selected piston of said pair is provided with frusto-conical forward and rear surfaces and said chamber includes a concave wall surface corresponding to said rear piston surface; and said other piston of said pair of pistons includes flat parallel end faces and includes a plurality of open-ended passageways therethrough.

2. The invention as defined in claim 1 wherein:

said input piston and cylinder assemblage includes an input ram carrying a piston on its end movable in a chamber;

said input piston having flat, parallel end surfaces and a plurality of open-ended passageways extending therethrough.

3. The invention as defined in claim 2 wherein:

said selected piston is so shaped that pressure applied equally on both sides results in lack of movement in either direction.

* * * * *